US009469385B2

(12) United States Patent
Imparato

(10) Patent No.: US 9,469,385 B2
(45) Date of Patent: Oct. 18, 2016

(54) ARRANGEMENT INTRODUCED IN STAND UP BOARD

(71) Applicant: WORK STATION COMÉRCIO DE PEÇAS LTDA-ME., São Paulo (BR)

(72) Inventor: Everson Imparato, São Paulo (BR)

(73) Assignee: WORK STATION COMERCIO DE PECAS LTDA-ME., Ibirapuera, Sao Paulo (BR)

( * ) Notice: Subject to any disclaimer, the term of this patent is extended or adjusted under 35 U.S.C. 154(b) by 0 days.

(21) Appl. No.: 14/536,309

(22) Filed: Nov. 7, 2014

(65) Prior Publication Data

US 2015/0133011 A1 May 14, 2015

(30) Foreign Application Priority Data

Nov. 8, 2013 (BR) ..... 202013028855

(51) Int. Cl.
*B63B 35/00* (2006.01)
*B63B 35/79* (2006.01)

(52) U.S. Cl.
CPC ..... *B63B 35/7906* (2013.01); *B63B 35/7933* (2013.01)

(58) Field of Classification Search
CPC ..... B63B 35/7933; B63C 11/49
USPC ..... 114/66
See application file for complete search history.

(56) References Cited

U.S. PATENT DOCUMENTS

| | | | | |
|---|---|---|---|---|
| 1,451,096 | A * | 4/1923 | Hagen | G02B 23/22 114/66 |
| 3,808,621 | A * | 5/1974 | French | B63C 11/49 114/66 |
| 6,572,424 | B2 * | 6/2003 | Harkrider | B63C 11/49 114/66 |
| 2013/0174768 | A1 * | 7/2013 | von der Goltz | B63B 35/73 114/66 |
| 2014/0063828 | A1 * | 3/2014 | Roach | B63B 35/7933 362/477 |

* cited by examiner

*Primary Examiner* — Stephen Avila
(74) *Attorney, Agent, or Firm* — Volpe and Koenig, P.C.

(57) ABSTRACT

The present invention refers to a stand-up board (1) endowed with a lighting system and an underwater viewing window (3) hermetically placed between the upper (2) and lower (8) plates, provided with a waterproof box for feeding battery (6), and a vapor purge valve (7); furthermore, the referred board has a visual alert signaling system (4 and 5) arranged along bow and stern of the respective stand-up board (1), that may be self-powered or use a feeding battery.

2 Claims, 1 Drawing Sheet

ARRANGEMENT INTRODUCED IN STAND UP BOARD

FIELD OF THE INVENTION

The present invention refers to a stand-up board, i.e. a surf board or stand-up paddleboard, more specifically to a lighting system for an underwater viewing window of the respective board and visual alert signaling system thereof.

BACKGROUND OF THE INVENTION

Stand-up boards known so far do not possess windows to observe the seabed provided with lighting to better watch the underwater creatures and visual alert signaling system.

More and more stand-up boards are spotted in beaches, lakes, lagoons or even in the open sea by adventurous adventurers who are fans of the sport; and evolutions to improve this type of surfing, both in the pleasure of surfing and in its safety are needed; furthermore, imminent risks for surfers when crossing other larger watercraft are increasingly frequent.

The objective of the present invention is that of endowing a stand-up board with a lighting system in a seabed inspection window, from which the surfer can watch and enjoy with higher clarity, underwater creatures while surfing.

Additionally, a further objective of the present invention is that of providing a visual alert signaling system for the stand-up board, aiming at increasing the safety for its surfer, mainly when surfing at night or in days of poor visibility.

BRIEF DESCRIPTION OF THE DRAWINGS

The present invention and its preferred embodiment of executing is described below, with reference to the accompanying Figures, which, in a schematic manner and non-limitative of the scope, represent.

DETAILED DESCRIPTION OF THE PREFERRED EMBODIMENTS

Figure 1:
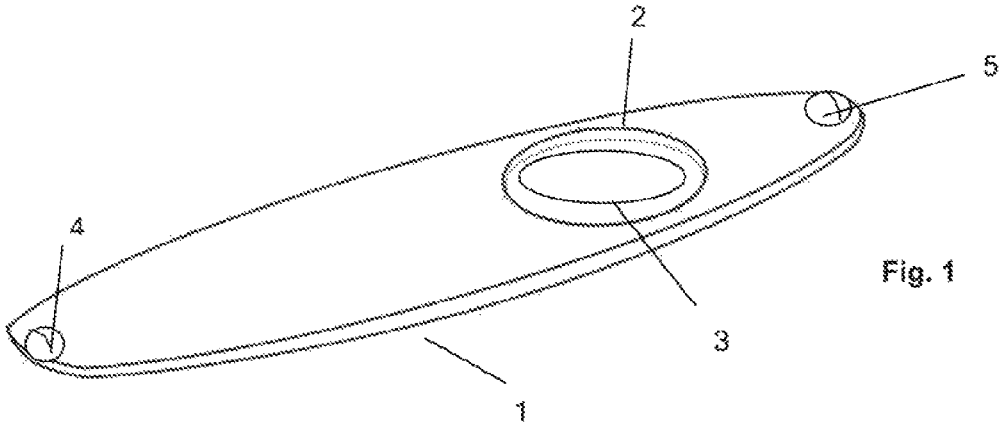
FIG. 1 illustrates a perspective view of the stand-up board, according to the present invention.
Figure 2:
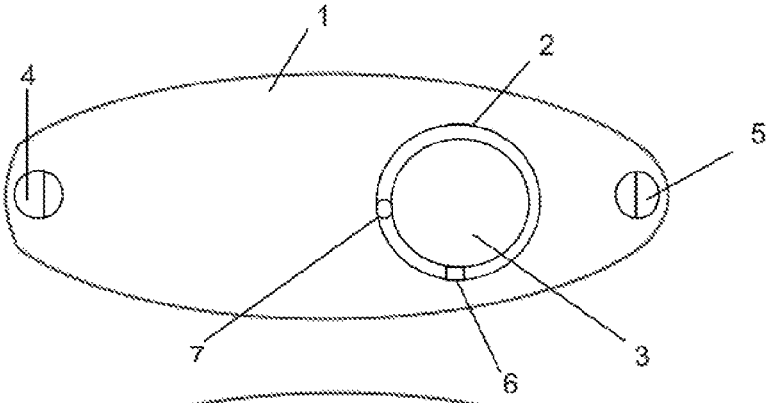
FIG. 2 illustrates a top view of the stand-up board, according to the present invention.
Figure 3:
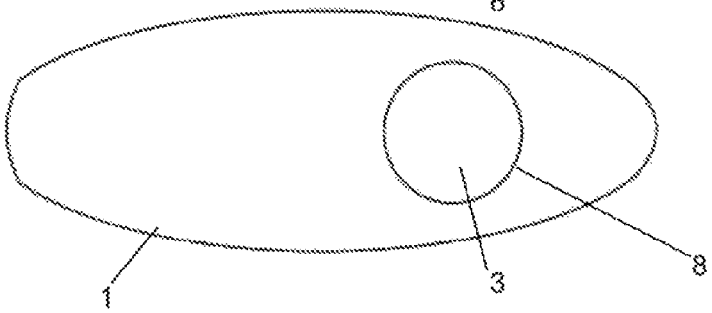
FIG. 3 illustrates a bottom view of the stand-up board, according to the present invention.
Figure 4:
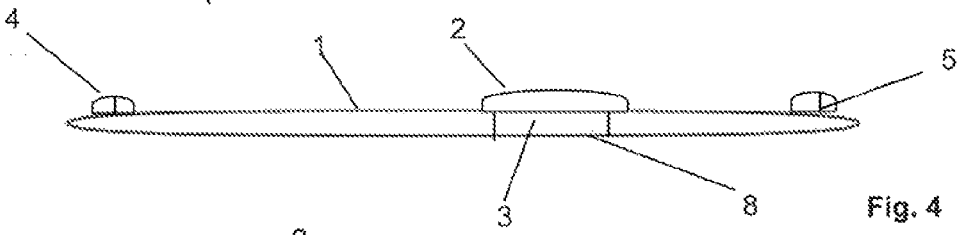
FIG. 4 illustrates a longitudinal sectional view of the stand-up board, according to the present invention.
Figure 5:
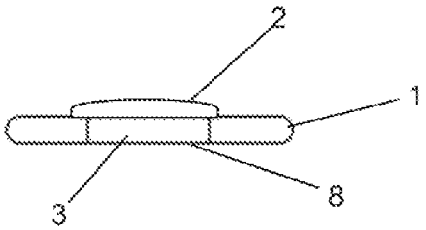
FIG. 5 illustrates a cross-sectional view of the stand-up board, according to the present invention.

The stand-up board according to the present invention consists in a board (1) provided with a window (3) having hermetic downward lighting, between the convex acrylic plate (2) mounted on top of the board, and the flat acrylic plate (8) mounted on the bottom of the board. In this window (3), also hermetically mounted between the respective acrylic plates, convex and flat, (2 *e* 8), there is a waterproof battery box (6) powering the lighting system, and a valve (7) to drain the water that may potentially arise from the evaporation of the air inside the window (3) during surfing. The lighting system may, optionally, be self-powered by its own batteries contained in it.

The convex acrylic plate (2) mounted on top of the board has such a shape to avoid that water accumulates on its surface; furthermore it is coated with an anti-glare film, thus avoiding the sunlight incidence on it, and largely improving the surfer's visibility of the depths.

The stand-up board (1) of the present invention is adjusted with visual alert indicator lights at stern (4) and visual alert indicator lights at bow (5), having fixed or flashing lights to alert other watercrafts.

Thanks to this lighting and signaling system the surfer of the stand-up board, subject matter of the present invention, can surf with more comfort and safety; thus, further modes of seabed observation window lighting or of signaling system may be implemented in stand-up board, according to the present invention, without departing from the spirit and scope of the following claims.

The invention claimed is:

1. Stand-up board (1), having a bow and a stern, comprising an underwater observation window (3), wherein the window comprises a convex acrylic plate (2) in an upper part and a flat acrylic plate (8) in a lower part of the board (1); further comprising downward lighting hermetically localized between the plates (2 and 8), and powered by waterproof battery box (6); and further comprising a vapor purge valve (7); and a visual alert signaling system at the stern (4) and a visual alert signaling system at the bow (5), both systems mounted on the stand-up board (1), wherein said signaling system is self-powered or powered by the waterproof battery box (6).

2. The stand-up board according to claim 1, wherein the upper convex acrylic plate (2) is coated with anti-glare film.

* * * * *